US007478884B2

(12) United States Patent
Kussel

(10) Patent No.: US 7,478,884 B2
(45) Date of Patent: Jan. 20, 2009

(54) HYDRAULIC SWITCHING MECHANISM FOR LONGWALL SUPPORTS

(75) Inventor: Willi Kussel, Werne (DE)

(73) Assignee: Tiefenbach Control Systems GmbH, Essen (DE)

( * ) Notice: Subject to any disclaimer, the term of this patent is extended or adjusted under 35 U.S.C. 154(b) by 244 days.

(21) Appl. No.: 11/420,317

(22) Filed: May 25, 2006

(65) Prior Publication Data

US 2007/0044647 A1 Mar. 1, 2007

Related U.S. Application Data

(63) Continuation of application No. PCT/DE2004/002546, filed on Nov. 18, 2004.

(30) Foreign Application Priority Data

Nov. 29, 2003 (DE) ..... 103 56 421

(51) Int. Cl.
*E21D 23/16* (2006.01)

(52) U.S. Cl. ..... 299/1.7

(58) Field of Classification Search ..... 299/1.05, 299/1.7, 1.6, 1.4
See application file for complete search history.

(56) References Cited

U.S. PATENT DOCUMENTS 5,181,451 A * 1/1993 Geuns et al. ..... 91/170 MP
5,490,384 A 2/1996 Lunzman et al.
2004/0221713 A1* 11/2004 Mundry et al. ..... 91/1

FOREIGN PATENT DOCUMENTS

DE 43 20 207 A1 12/1994

OTHER PUBLICATIONS

International Search Report for International Appl. No. PCT/DE2004/002546, completed Mar. 24, 2005.
International Preliminary Report on Patentability for International Appl. No. PCT/DE2004/002546, issued Jul. 27, 2006.
Written Opinion for International Appl. No. PCT/DE2004/002546, mailed Apr. 4, 2005.

* cited by examiner

*Primary Examiner*—John Kreck
(74) *Attorney, Agent, or Firm*—Alston & Bird LLP

(57) ABSTRACT

A hydraulic switching mechanism for longwall supports. The present invention provides a hydraulic system that is controlled by its own pressure and may be adaptable to those currently in use so that life-threatening and costly faults cannot occur. With the present invention, the retrofitting of existing systems may be made possible without significant expenditure in modification.

4 Claims, 2 Drawing Sheets

HYDRAULIC SWITCHING MECHANISM FOR LONGWALL SUPPORTS

CROSS REFERENCE TO RELATED APPLICATION

The present application is a continuation of international application PCT/DE 2004/002546, filed 18 Nov. 2004, and which designates the U.S. The disclosure of the referenced application is incorporated herein by reference.

BACKGROUND OF THE INVENTION

The invention relates to a hydraulic switching mechanism for longwall supports. Similar switching mechanisms are generally known and in use. They are hydraulic systems controlled by their own pressure. In these, the pump pressure of the hydraulic circuit is also used for hydraulic pilot control of the valves. This procedure has been successful in the control of supports. It allows the system to function with only two feed lines in the longwall. In contradistinction to this, in systems under external control, the hydraulic pilot control commands are generated via separate control valves operating independently of load pressure or pump pressure, the control valves being supplied with pressurizing medium via separate pressure lines. However, a part of any system of this type is also separate return flow management of all the control volumes. Also due to this, the complexity of the tubing is increased. In case faults appear, the localization of the fault is very difficult since it is not to be ruled out that the two pressure feeds, i.e. operating pressure feed and pilot control feed, interact. Also, the valve construction is significantly more complicated, in particular with regard to pressure equalization and sealing, due to the requirement of decoupling of the operating pressure from the pilot control pressure.

On the other hand, in view of the high level of complexity and the plurality of the switching elements and control elements located in the longwall, in particular control valves and load-maintaining valves, the high safety standards in mining entail a great expenditure in protective measures, even for hydraulic systems controlled by their own pressure. In this connection the basic rule applies that the hydraulic system for the shield support has to ensure that despite the large number of possible operating states, including impermissible operating states or unplanned faults, the personnel below ground can stay under the shields safely, even in the area of the longwall.

Despite these protective measures, it has been observed that in case of a fault in the operation of the pump, the ram (ram cylinder) of a shield, and in rapid temporal sequence also the ram cylinders of other shields, have slackened so that the rock mass could sag.

The objective of the invention is to develop hydraulic systems controlled by their own pressure and currently in use so that life-threatening and costly faults of this type cannot occur, and where the retrofitting of existing systems is also made possible without significant expenditure in modification.

SUMMARY OF THE INVENTION

The above objectives and others are realized according to the invention by providing, in one embodiment, a hydraulic switching mechanism for longwall supports comprising one or more shields that can be actuated in the sense of support functions of setting and removing props for the support of a rock mass, one or more hydraulically actuated rams that are assigned to each of the shields for the execution of operational functions required for the support functions, one or more hydraulic control valves that can be actuated by positioning commands output to electromagnets and are each assigned to one of the rams for hydraulic triggering of the operational functions of the ram and are connected to it hydraulically, an electronic control unit for each of the shields for triggering positioning commands with the aid of support commands that can be input into the individual shield control, a pump line for feeding pressurizing medium to all the rams which is connected in each case via a pump branch line to at least one ram, a return flow line for draining pressurizing medium from the rams that are connected in each case via a return flow branch line to at least one ram, and a block valve located in the pump branch line that blocks a direction of flow from the respective ram to the pump line and that can be actuated independently of activation and switch positions of the hydraulic control valves. The realization according to the present invention is based on the unexpected insight that in the case of faults in the pumping system, despite the emergency shutdown of all electrical and hydraulic control, there are unforeseen operating states in which pressure ratios occur which are sufficient for hydraulic pilot control, i.e. opening of important valves.

The block valve according to the invention can, for example, be switched in the blocked state by a pressure sensor which detects the pump pressure. In each case the switching is done in such a manner that the block valve opens if there is a drop in pressure from the pump branch line to the ram.

The positive effect of the measures according to this embodiment is unexpected. It can be explained by the fact that in case of a fault which occurs in the operation of the pump and leads to the lowering of the ram, stagnation pressure develops in the return flow line, the stagnation pressure affecting in particular the nearest shield (support frame). Since in cases of this type, i.e. in case of high stagnation pressure in the return flow, the load pressure that is caused by the rock mass may be relatively low and pump pressure is not available due to the fault, the drop in pressure at the load-maintaining valves sinks below the critical value at which the load-maintaining valves open and an unintended switching and lowering of the ram can also occur at the neighboring shields. Due to the fact that the unintended increase of the pressure which is in the pump line and is active in pilot control is prevented by the block valve according to the invention, the lowering of the neighboring frames of a support frame affected by a faulty switching is also prevented.

In one embodiment, the block valve may be a non-return valve that blocks the direction of flow from the respective ram to the pump line. This embodiment is distinguished by the fact that it needs no external control and thus on the one hand is reliable in operation and on the other hand can also be retrofitted in a simple manner.

In another embodiment, several controllable section block valves may be each installed in the pump line at an interval of one or more shields, which can be controlled by central electrical control of the longwall in such a manner that the section block valves are first blocked during startup of the pumps and are then once again switched on and opened in sequence.

In still another embodiment, the presence of a predefined minimum pressure in the pump line or a predefined maximum pressure in the return flow line is monitored at an interval of one or more support frames by pressure sensors that are connected to a shutdown mechanism of the electrical control unit.

BRIEF DESCRIPTION OF THE DRAWINGS

Figure 1:
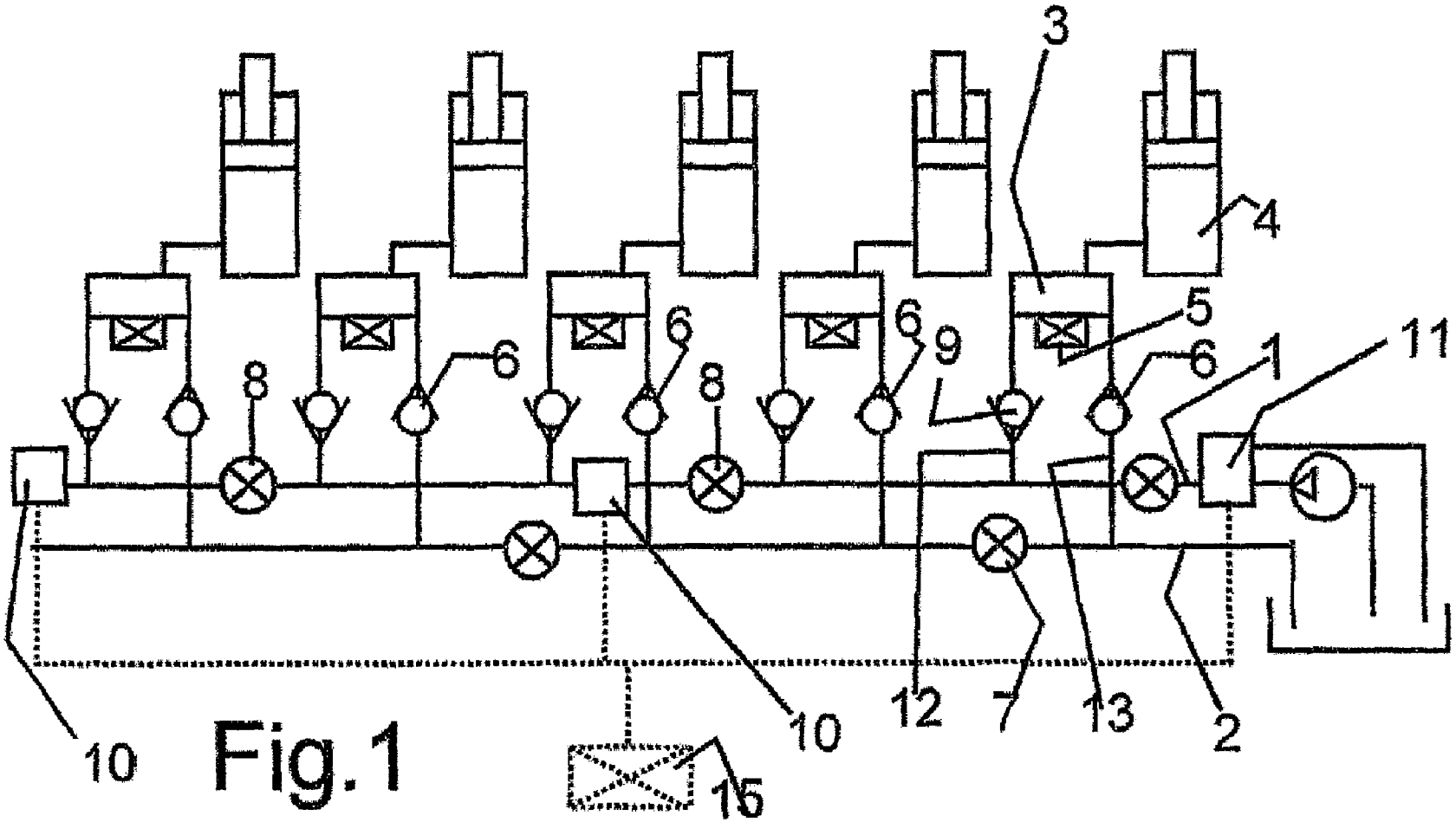
Figure 2:
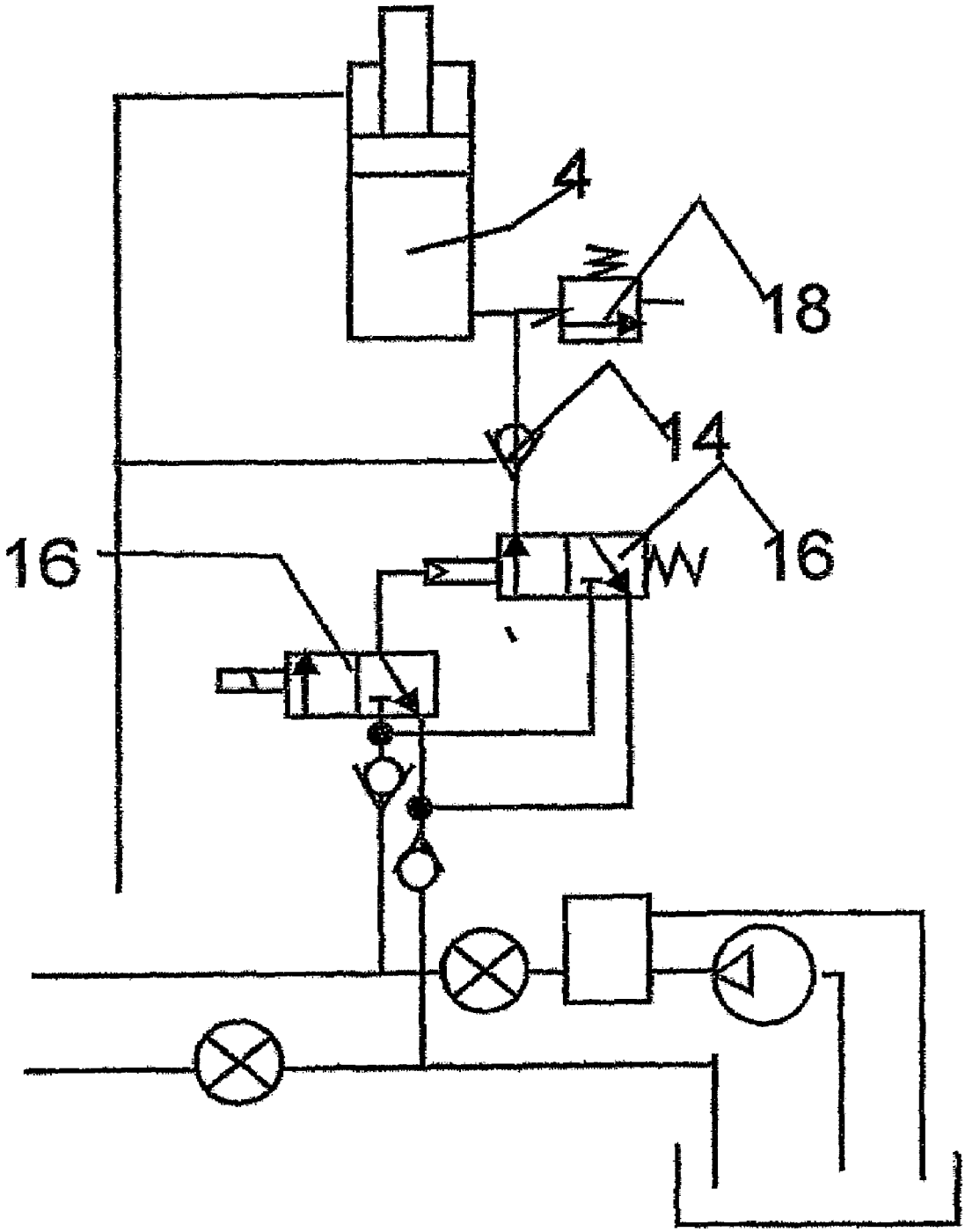

Having thus described the invention in general terms, reference will now be made to the accompanying drawings, which are not necessarily drawn to scale, and wherein:

FIG. 1 depicts the hydraulic switching mechanism of a longwall in accordance with one embodiment of the present invention; and FIG. 2 depicts the valves for a ram of a support frame in accordance with one embodiment of the present invention.

DETAILED DESCRIPTION OF THE INVENTION

The present invention now will be described more fully hereinafter with reference to the accompanying drawings, in which some, but not all embodiments of the invention are shown. Indeed, the present invention may be embodied in many different forms and should not be construed as limited to the embodiments set forth herein; rather, these embodiments are provided so that this disclosure will satisfy applicable legal requirements. Like numbers refer to like elements throughout.

Referring to FIGS. 1 and 2, a longwall feed line 1 extends over a part of the longwall or along the whole length of the longwall and is connected to a pumping station (not represented). A collecting return flow line 2 (return flow collector line, return flow) extends over a part of the longwall or along the whole length of the longwall and is connected to the tank of the pumping station. A hydraulic control device 3 for a ram is connected via the feed branch line 12 to the feed and via the return flow branch line 13 to the return flow. A ram 4 is also depicted, represented here as a cylinder-piston unit. An electrical control unit 5 (shield control) for controlling the hydraulic control unit receives its switching commands from a central longwall control device 15. A block valve is formed in the return flow branch line 13 to each shield as a non-return valve 6 that blocks the direction of flow of the return flow collector line to the hydraulic control unit.

Several valves are part of the hydraulic control unit. These are indicated in the schematic drawing according to FIG. 2. In principle, the connection (pump branch line) of each ram to the pump collector line of the longwall is blocked by a non-return valve 14 so that in case of a loss of the pump pressure, the retaining force of the ram is borne on the tightly sealing non-return valve. This non-return valve 14 can, however, be unblocked by the hydraulic pilot control based on the system pressure if the difference in load pressure and pilot control pressure falls below a predefined value. The non-return valve 14 is hydraulically switched so that, in case of hydraulic unblocking, the work space of the ram is connected via the return flow branch line to the return flow collector line. A deblockable non-return valve of this type is, for example, known from DE 38 04 848 A1.

By the block valve 6 according to the invention it is prevented that in case of unintended deblocking (notching up) of this non-return valve 14 acting as a load-maintaining valve, pressurizing medium from the cylinder space of the ram arrives in the pump line. The pump branch line between the ram and the pump collector channel is therefore also blocked. In the pump collector line (longwall feed line 1) several pressure sensors 7 are disposed at an interval of one or more support frames. These pressure sensors ensure that in any case a certain minimum pressure of, for example, 200 bar, is present in the pump collector line. Otherwise, there would be a shut-down of the electrical system 5 by which the shield actuation is switched on. It is also prevented that the electrical system is switched on for shield actuation if the minimum pressure is not reached.

Pressure sensors 8 are provided in the return flow collector line. For example, three pressure sensors 8 of this type are distributed over the length of the longwall. These sensors monitor that a certain maximum pressure, for example, 30 bar, is not exceeded in the return flow. When the maximum pressure is reached, these sensors 8 switch off the electronics 5 so that actuation of the valves is no longer possible.

Now it can happen that a drop in pressure in the pump collector line or an increase in pressure in the return flow collector line occurs while an electrical command for a switching process is present at one or more shields (support frames). In this case, the switching process is in fact interrupted but the electrical commands continue to be present and are activated once again on reaching a certain pressure level. Thus, the valves go into an undefined switch position. A drop in pressure of this type can, for example, be due to a failure of the pump or pumping station. Due to this, it can happen that the piston in a ram of this type, whose operation has been interrupted by the execution of a support function, lowers. The lowering has as a consequence, on the one hand, a large amount of fluid in the return flow with corresponding increase of the stagnation pressure and, on the other hand, a lowering of the load pressure by which the deblockable non-return valve 14 is held in its blocking position. Due to this, the danger of still further opening of the non-return valve is increased since the pressure ratio required for closing is no longer maintained with lowering of the load pressure on the one hand and increase of the return flow pressure on the other hand.

A similar situation arises if, on lowering of the pump pressure in the pump collector line at the deblockable non-return valve 14, the pump pressure is present in the sense of opening and in addition the pilot control piston is pressurized in the sense of opening by the floating position of the pilot control valve 16. In this case, deblocking of the non-return valve also occurs, due to which the load space of the ram is connected to the pump collector line. Due to this, the ram acts as a pump and, despite the failure of the pumping station, feeds pressurizing medium into the pump collector line, which, as a consequence, leads, when electrical signals are present, to the now once more increasing pressure in the pump collector line being sufficient as a pilot control pressure for switching of the valves of neighboring shields. With this, a chain reaction occurs with the sagging of all the shields of a longwall.

This is prevented by the block valves 9 which are present in the branch line between the pumping station and the hydraulic control 3.

Undefined hydraulic situations can also occur due to the fact that during a restart of the pumps, the pressure in the pump collector line, which may be hundreds of meters long, does not increase rapidly enough so that, on the one hand, a switching of the pilot-controlled valves already occurs but, on the other hand, the pump pressure is not sufficient to bear the load of the rock mass. Also in this case, slacking of the ram cylinders can occur. For this reason, controllable block valves 10 are installed in the pump collector line at intervals of several, e.g., 3 shields, said block valves first being blocked on startup of the pumps, then being switched on and opened once again by the central electronic control of the longwall. Thereby it is achieved that the pressure build-up in the individual sections of the longwall, which are divided by the section block valve 10, goes very rapidly if the sections are opened in sequence. Furthermore, in the pumping station a short-circuit valve (longwall shut-off valve 11) can be provided through which the pumps discharge into the tank as long as they are still in startup and thus have still not reached a sufficient amount.

Through the invention and the additional measures also applicable and effective, the dangerous situation is avoided in which, with the magnetic valve switched and pump pressure in the longwall lacking, a single common connection to all the control units of the longwall is created. In this case, flow paths into the valves can arise since the system pressure monitoring is not operative in case of failure of the pumps or too low pump pressure. This leads to the valves letting a constant volume flow pass into the return flow collector line and on reaching the critical control pressure limit deblocking of the load-maintaining valve (deblockable non-return valve) taking place. Particularly endangered here are rams which are not set, or are set only with slight pressure, since the opening pressure of the load-maintaining valves is dependent on the load pressure, as described above. Also, hydraulically unloaded load-maintaining valves, whose opening force depends on a spring force, have sufficient opening pressure, e.g. only 40 bar, without load pressure being present.

By the block valves 9 it is prevented that the volumes of the shield rams and cylinders in the pressure-loaded state act as a pump which with, in fact too low, pressure leads to back feed and insufficient feed into the neighboring shields, where then at low load pressures the effective control and deblocking of the load-maintaining valves occurs, which in turn frees additional volumes which lead to further chain reactions.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A hydraulic switching mechanism for longwall supports comprising:

one or more shields that can be actuated in the sense of support functions of setting and removing props for the support of a rock mass;

one or more hydraulically actuated rams that are assigned to each of the shields for the execution of operational functions required for the support functions;

one or more hydraulic control valves that can be actuated by positioning commands output to electromagnets and are each assigned to one of the rams for hydraulic triggering of the operational functions of the ram and are connected to it hydraulically;

an electronic control unit for each of the shields for triggering positioning commands with the aid of support commands that can be input into the individual shield control;

a pump line for feeding pressurizing medium to all the rams which is connected in each case via a pump branch line to at least one ram;

a return flow line for draining pressurizing medium from the rams that is connected in each case via a return flow branch line to at least one ram; and a block valve located in the pump branch line that blocks a direction of flow from the respective ram to the pump line and that can be actuated independently of activation and switch positions of the hydraulic control valves.

2. The hydraulic switching mechanism according to claim 1, wherein the block valve is a non-return valve that blocks the direction of flow from the respective ram to the pump line.

3. A hydraulic switching mechanism for longwall supports comprising:

one or more shields that can be actuated in the sense of support functions of setting and removing props for the support of a rock mass;

one or more hydraulically actuated rams that are assigned to each of the shields for the execution of operational functions required for the support functions;

one or more hydraulic control valves that can be actuated by positioning commands output to electromagnets and are each assigned to one of the rams for hydraulic triggering of the operational functions of the ram and are connected to it hydraulically;

an electronic control unit for each of the shields for triggering positioning commands with the aid of support commands that can be input into the individual shield control;

a pump line for feeding pressurizing medium to all the rams which is connected in each case via a pump branch line to at least one ram;

a return flow line for draining pressurizing medium from the rams that is connected in each case via a return flow branch line to at least one ram; and a block valve located in the pump branch line that blocks a direction of flow from the respective ram to the pump line and that can be actuated independently of activation and switch positions of the hydraulic control valves, wherein several controllable section block valves are each installed in the pump line at an interval of one or more shields, which can be controlled by central electrical control of the longwall in such a manner that the section block valves are first blocked during startup of the pumps and are then once again switched on and opened in sequence.

4. The hydraulic switching mechanism according to claim 1, wherein the presence of a predefined minimum pressure in the pump line or a predefined maximum pressure in the return flow line is monitored at an interval of one or more support frames by pressure sensors that are connected to a shutdown mechanism of the electrical control unit.

* * * * *